US011703788B2

(12) United States Patent
Sano

(10) Patent No.: US 11,703,788 B2
(45) Date of Patent: Jul. 18, 2023

(54) IMAGE FORMING APPARATUS WITH DETECTION OF STATE OF EXPOSURE UNIT

(71) Applicant: CANON KABUSHIKI KAISHA, Tokyo (JP)

(72) Inventor: Atsushi Sano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/465,317

(22) Filed: Sep. 2, 2021

(65) Prior Publication Data

US 2022/0082972 A1 Mar. 17, 2022

(30) Foreign Application Priority Data

Sep. 14, 2020 (JP) ..... 2020-153953

(51) Int. Cl.
*G03G 15/00* (2006.01)

(52) U.S. Cl.
CPC ..... *G03G 15/5016* (2013.01); *G03G 15/55* (2013.01)

(58) Field of Classification Search
CPC ..... G03G 15/5016; G03G 15/55
See application file for complete search history.

(56) References Cited

U.S. PATENT DOCUMENTS 6,297,839 B1 10/2001 Komiya et al.
7,557,823 B2 7/2009 Ono et al.

FOREIGN PATENT DOCUMENTS

JP 2000-284198 A 10/2000
JP 2005-219386 A 8/2005
JP 2007-083708 A 4/2007
JP 2009-181080 A 8/2009
JP 2015215486 A * 12/2015

* cited by examiner

*Primary Examiner* — Victor Verbitsky
(74) *Attorney, Agent, or Firm* — Venable LLP

(57) ABSTRACT

An image forming apparatus includes an exposure unit provided with a rotatable polygon mirror including a plurality of reflecting surfaces for scanning a light beam emitted from a light source to expose a photosensitive member with the light beam according to image information. A determining unit determines an end of lifetime of the exposure unit based on a detecting result of density of a toner image detected by two detecting units at a first timing and a detecting result of density of the toner image detected by the two detecting units at a second timing after the first timing.

9 Claims, 10 Drawing Sheets

(a)

(b)

IMAGE FORMING APPARATUS WITH DETECTION OF STATE OF EXPOSURE UNIT

FIELD OF THE INVENTION AND RELATED ART

The present invention relates to an image forming apparatus, for example, a color image forming apparatus capable of detecting a degradation state of a scanning optical device which applies an electrophotographic technology, such as a copier and a laser beam printer.

Since a rotatable polygon mirror in a scanning optical device used in an image forming apparatus which applies an electrophotographic technology rotates at high speed, a reflecting surface which reflects a laser light is contaminated with dust and dirt in air. On the reflecting surface of the rotatable polygon mirror, a contamination of an edge portion of a leading end in a rotating direction is particularly significant, and a density of an image edge portion in a main scanning direction is decreased due to the contamination, and this causes image defects. As a means of detecting the contamination of the reflecting surface, there is a method of detecting an intensity of the laser light reflected from the reflecting surface of the rotatable polygon mirror by a light detection element for power detecting, for example, in Japanese Laid-Open Patent Application (JP-A) 2000-284198. In addition, for example, in JP-A 2007-083708, a means of extending a life of a scanning optical device against image degradation in case of a reflecting surface of a rotatable polygon mirror of an opposite scanning type of a scanning optical device used in a color image forming apparatus is contaminated is proposed.

However, conventional embodiments have following challenges. In recent years, there has been a growing demand for stable image quality throughout an operating period of an image forming apparatus, and in particular, a functional deterioration of a scanning optical device which is responsible for latent image formation directly affects image quality. Therefore, it is necessary to detect a degradation state of a scanning optical device promptly and at an accurate timing. In a method using a light detection element for power detecting, the light detection element receives a laser light reflected outside an image forming region of a reflecting surface of a rotatable polygon mirror. Therefore, in order to detect a functional deterioration of a scanning optical device more accurately, it is necessary to detect a contamination of a reflecting surface corresponding to inside an image forming region. In addition, it is also necessary to provide a light detection element to detect a laser light with an image forming apparatus.

Next, as a technology to reduce a degradation of an image density caused by contamination of a reflecting surface of a rotatable polygon mirror, a technology to store a plurality of shading correction data in advance and to select arbitrary shading correction data is proposed. However, although this technology is capable of extending a life of a scanning optical device, it will eventually cause the image degradation, and it will be necessary to replace the scanning optical device in a long-life image forming apparatus which prints a large number of sheets.

SUMMARY OF THE INVENTION

An object of the present invention is to provide an image forming apparatus to accurately detect the contamination of the rotating polygon mirror of a scanning optical device in a simple way without using a dedicated optical detection element.

According to an aspect of the present invention, there is provided an image forming apparatus for forming a toner image on a recording material, the image forming apparatus comprising a photosensitive member, an exposure unit provided with a light source and a rotatable polygon mirror including a plurality of reflecting surfaces for scanning a light beam emitted from the light source, and configured to expose said photosensitive member with the light beam according to image information, a developing unit configured to develop an electrostatic latent image formed on the photosensitive member by the exposure unit and to form the toner image, an image bearing belt, a transfer unit configured to transfer the toner image formed on the photosensitive member to said image bearing belt, at least two detecting units configured to detect the toner image formed on the image bearing belt, and a determining unit configured to determine an end of lifetime of the exposure unit based on a detecting result of density of the toner image detected by the two detecting units at a first timing, and a detecting result of density of the toner image detected by the two detecting units at a second timing after the first timing.

Further features of the present invention will become apparent from the following description of exemplary embodiments (with reference to the attached drawings).

DESCRIPTION OF THE EMBODIMENTS

In the following, embodiments of the present invention will be described in detail with reference to the Figures.

EMBODIMENTS (Color Image Forming Apparatus)

Figure 1:
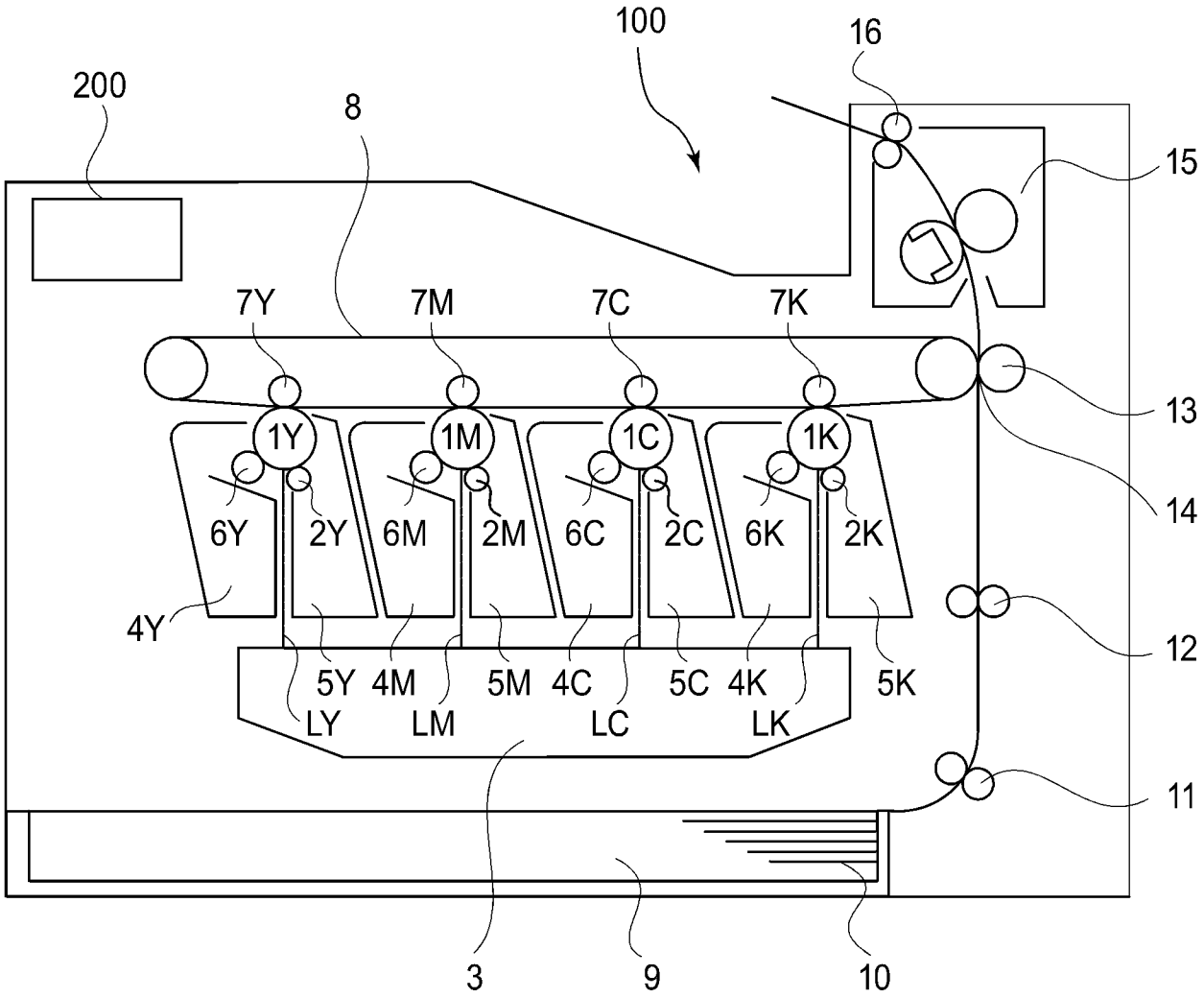
FIG. 1 is a view showing an image forming apparatus in an embodiment of the present invention.

FIG. 1 is a sectional view showing a configuration of an image forming apparatus 100 which includes a scanning optical device 3 in this embodiment. The image forming apparatus 100 is an electrophotographic color image forming apparatus which is provided with developers (toners) of four colors, yellow (Y), magenta (M), cyan (C), and black (K), and forms a toner image on a recording material 10. Incidentally, in the following description, characters of Y, M, C, and K are omitted, except in a case of referring to a member corresponding to a specific color. A laser light L as a light beam is emitted on a surface of a photosensitive drum 1, which is uniformly charged by a charging roller 2 as a charging unit. The laser light L is emitted from a light source (not shown) corresponding to each color in a scanning optical device 3 as an exposure unit, based on image data input from an image data input portion (not shown). As a result, an electrostatic latent image is formed on the surface of the photosensitive drum 1. A toner of each color is supplied from a developing roller 6 in a developing device 4 as a developing unit to the electrostatic latent image formed on the surface of the photosensitive drum 1 and the latent image is developed, and a toner image of each color on the surface of each photosensitive drum 1 is formed. An intermediary transfer belt 8 as an image bearing belt is stretched and arranged to face the photosensitive drums 1. The toner image of each color formed on the surface of each photosensitive drum 1Y, 1M, 1C, and 1K is sequentially superimposed and transferred to an outer peripheral surface of the intermediary transfer belt 8 and a color toner image is formed (hereinafter referred to as primary transfer). Primary transfer is performed by applying a primary transfer voltage to primary transfer rollers 7Y, 7M, 7C, and 7K as primary transfer units arranged on a side of an inner peripheral surface of the intermediary transfer belt 8.

On the other hand, the recording material 10 is stacked in a feeding cassette 9, and the recording material 10 is fed to a feeding passage by a feeding roller 11 and then fed by a feeding roller 12. After that, the recording material 10 is fed at a predetermined timing to a secondary transfer portion 14 which is a nip portion between the intermediary transfer belt 8 and a secondary transfer roller 13 as a secondary transfer unit. And the color toner image on the outer peripheral surface of the intermediary transfer belt 8 is transferred to the recording material 10 by applying a secondary transfer voltage to the secondary transfer roller 13 (hereinafter referred to as a secondary transfer). After that, the recording material 10 is nipped and fed between the secondary transfer roller 13 of the secondary transfer portion 14 and the intermediary transfer belt 8, and fed to a fixing device 15 as a fixing unit. The recording material 10 is heated and pressed by the fixing device 15 and an unfixed toner image is fixed, and is fed out of the image forming apparatus 100 by a discharging roller 16. The image forming apparatus 100 is provided with a control portion 200 as a control unit. The control portion 200 includes, for example, a CPU, a ROM, and a RAM, and controls various processes related to image formation by reading various programs stored in the ROM and executing the read programs while using the RAM as a workspace. Incidentally, the image forming apparatus 100 is provided with at least two density sensors (not shown in FIG. 1), which are detecting units as described below.

(Scanning Optical Device)

Figure 2:
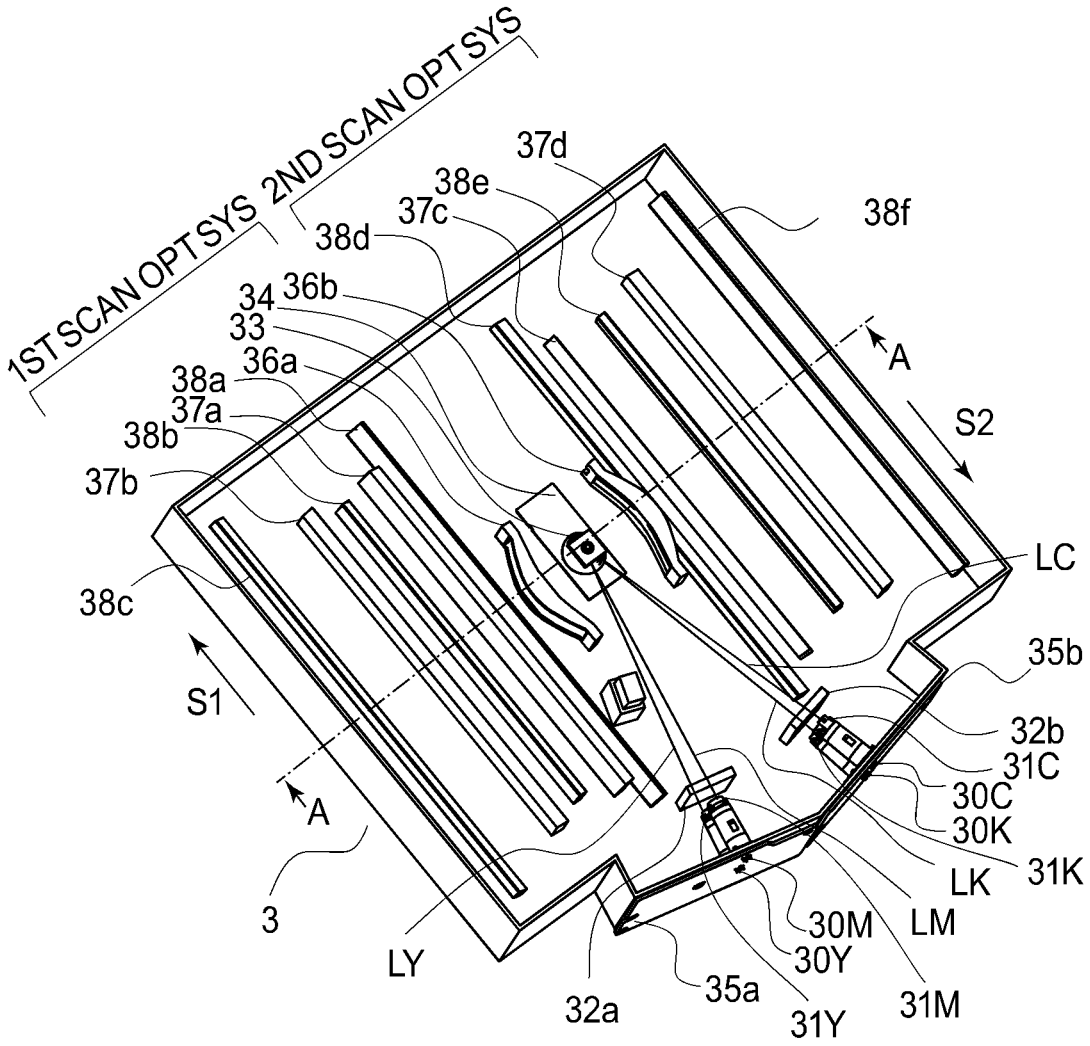
FIG. 2 is a perspective view showing a configuration of a scanning optical device in the embodiment.
Figure 3:
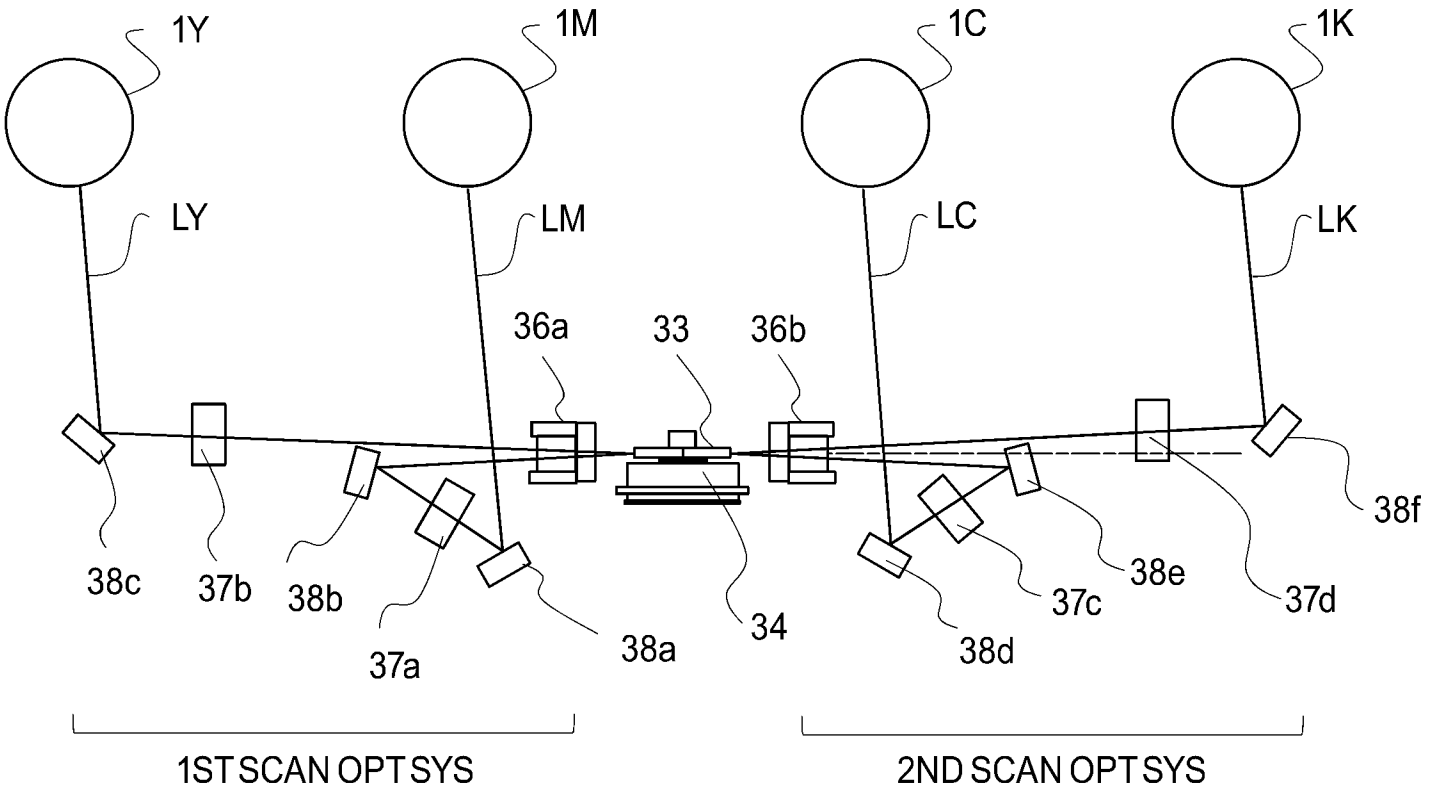
FIG. 3 is a sectional view along line A-A in FIG. 2 of the embodiment.

FIG. 2 and FIG. 3 are views showing overall configurations of the scanning optical device 3. FIG. 2 is a perspective view showing an inside of the scanning optical device 3 in this embodiment (a cover member is not shown). FIG. 3 is a view of a main portion showing a scanning optical system, and is a sectional view along line A-A in FIG. 2. The scanning optical system 3 includes a semiconductor laser 30Y, which is a first light source for forming an electrostatic latent image corresponding to yellow, and a semiconductor laser 30M for forming an electrostatic latent image corresponding to magenta. In addition, the scanning optical device 3 includes a semiconductor laser 30C for forming an electrostatic latent image corresponding to cyan, and a semiconductor laser 30K, which is a second light source for forming an electrostatic latent image corresponding to black. The characters of Y, M, C, and K may be omitted as described above. A circuit board 35*a* is a board on which various elements for driving the semiconductor lasers 30Y and 30M are mounted. A circuit board 35*b* is a board on which various elements for driving the semiconductor lasers 30C and 30K are mounted. The semiconductor lasers 30Y, 30M, 30C, and 30K, which are driven and controlled by the circuit boards 35*a* and 35*b*, emit divergent laser lights LY, LM, LC, and LK, respectively. Each laser light L is converted into a collimated laser light flux by each collimator lens 31. The laser lights LY and LM are converged only in a subscanning direction by passing through a cylindrical lens 32*a*, and laser lights LC and LK are converged only in the subscanning direction by passing through a cylindrical lens 32*b*. Here, the subscanning direction refers to the rotational direction of the photosensitive drum 1. Then, each laser light L is formed as a line image on the reflecting surface of the rotatable polygon mirror 33. Incidentally, in this embodiment, the rotatable polygon mirror 33 includes, for example, four reflecting surfaces. Incidentally, the rotatable polygon mirror 33 may include a plurality of reflecting surfaces and include other numbers of reflecting surfaces.

Next, the scanning optical system will be described using Figures FIG. 2 and FIG. 3. The rotatable polygon mirror 33 is rotated and driven by a scanner motor 34 and deflects the laser lights LY, LM, LC, and LK. The laser lights LY and LM deflected by the rotatable polygon mirror 33 pass through a first scanning lens 36*a*. Then, the laser light LY passes through a second scanning lens 37*b*, is reflected by a reflecting mirror 38*c*, and is formed as a spot image on the photosensitive drum 1Y. On the other hand, the laser tights light LM, after being reflected by a returning mirror 38*b*, passes through a second scanning lens 37*a*, is reflected by a returning mirror 38*a*, and is formed as a spot image on the photosensitive drum 1M. In the same manner, the laser lights LK and LC pass through a first scanning lens 36*b*. Then, the laser light LK passes through a second scanning lens 37*d*, is reflected by a returning mirror 38*f*, and is formed as a spot image on the photosensitive drum 1K. On the other hand, the laser light LC, after being reflected by a returning mirror 38*e*, passes through a second scanning lens 37*c*, is reflected by a returning mirror 38*d*, and is formed as a spot image on the photosensitive drum 1C.

The direction in which the laser lights LY and LM are deflected by the rotatable polygon mirror 33 is an arrow S1 direction, which is a first scanning direction shown in FIG. 2. On the other hand, the direction in which the laser lights LC and LK are deflected by the rotatable polygon mirror 33 is an arrow S2 direction as a second scanning direction, which is the opposite direction of the arrow S1 shown in FIG. 2. The direction of the arrow S1 and the arrow S2 is also the main scanning direction, and the main scanning direction is substantially perpendicular to the subscanning direction. That is, the rotatable polygon mirror 33 rotates in a clockwise direction when viewed from a top (an open side of a casing which is covered by the cover member (not shown)) in FIG. 2. The scanning optical device 3 is, what is referred as, an opposite scanning optical system which includes scanning optical systems on both left side and right side, in the case shown in FIG. 3, across the rotatable polygon mirror 33. Expediently, an optical system as a first optical member which contributes to a deflection scanning of the laser lights LY and LM is referred to as a first scanning optical system, and an optical system as a second optical member which contributes to a deflection scanning of the laser lights LC and LK is referred to as a second scanning optical system. The image forming apparatus 100 guides a scanning light on the four photosensitive drums 1Y, 1M, 1C, and 1K by such a scanning optical system, and records an image.

(Contamination of the Reflecting Surface of the Rotatable Polygon Mirror)

Figure 4:
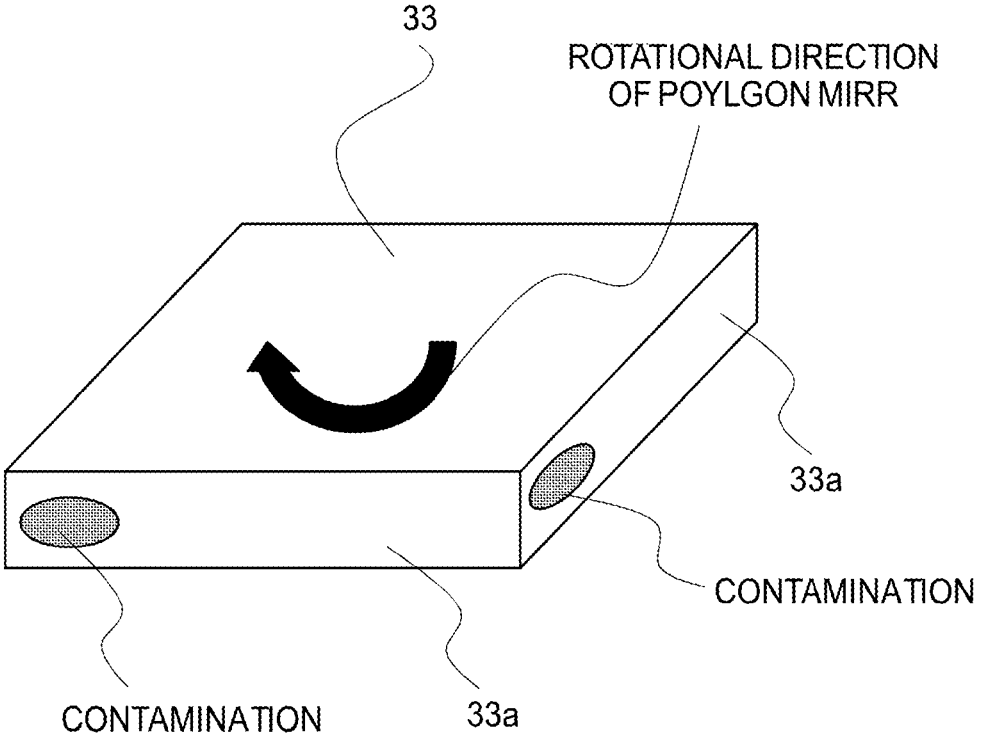
FIG. 4 is a view showing a contamination of a reflecting surface of a rotatable polygon mirror in the embodiment.

Next, with reference to FIG. 4 and FIG. 5, a state of the reflecting surface of the rotatable polygon mirror 33 when an operation of the image forming apparatus 100, in other words, a use of the scanning optical system 3, has been prolonged, and an intensity of a laser light L on the photosensitive drum 1 at the time will be described. FIG. 4 shows a state of contamination of a reflecting surface 33*a* of the rotatable polygon mirror 33. Since the rotatable polygon mirror 33 is rotating at a high speed of approximately 4,000 rpm, the reflecting surface 33*a* is contaminated by dust and dirt floating in air. In particular, a downstream side in a rotational direction of each reflecting surface 33*a* (a left side of the reflecting surface 33*a* shown in FIG. 4) is in a shadow of a corner of the reflecting surface 33*a*, which causes negative pressure and easily incorporates dust and dirt. Therefore, it is easier to be contaminated than other regions of the reflecting surface 33*a*, that is, regions excluding the downstream side in the rotational direction (i.e., an upstream side (right side) and a center with respect to the rotational direction).

Figure 5:
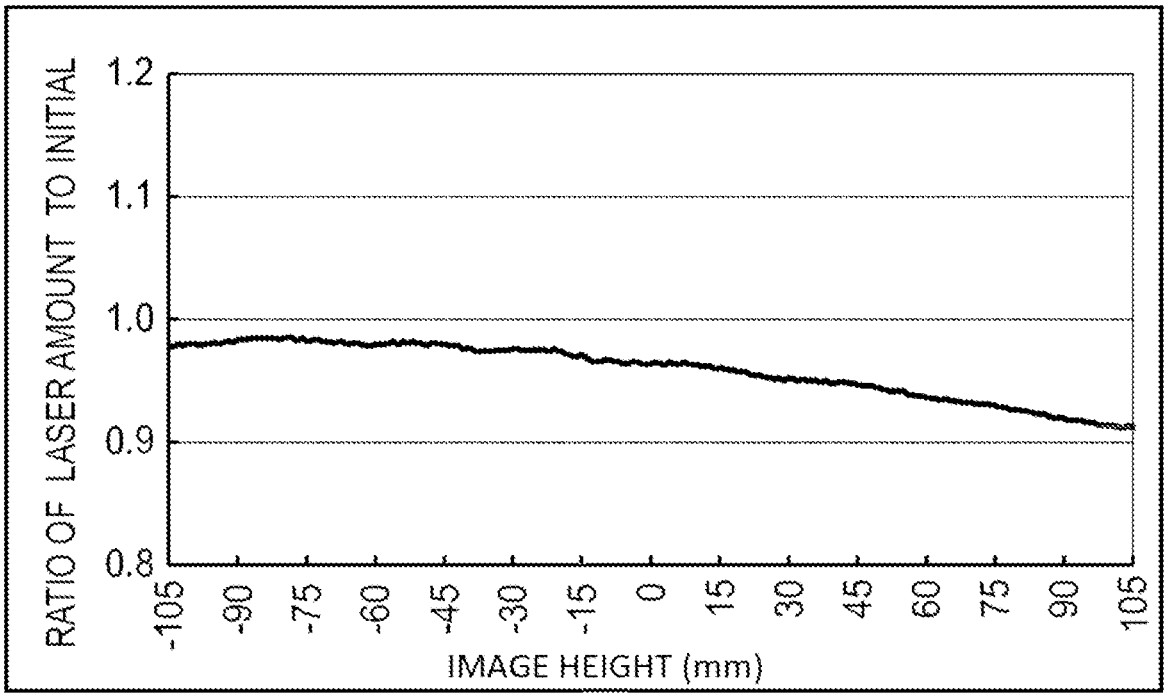
FIG. 5 is a view showing a laser intensity on a photosensitive drum in the embodiment.
Figure 5:
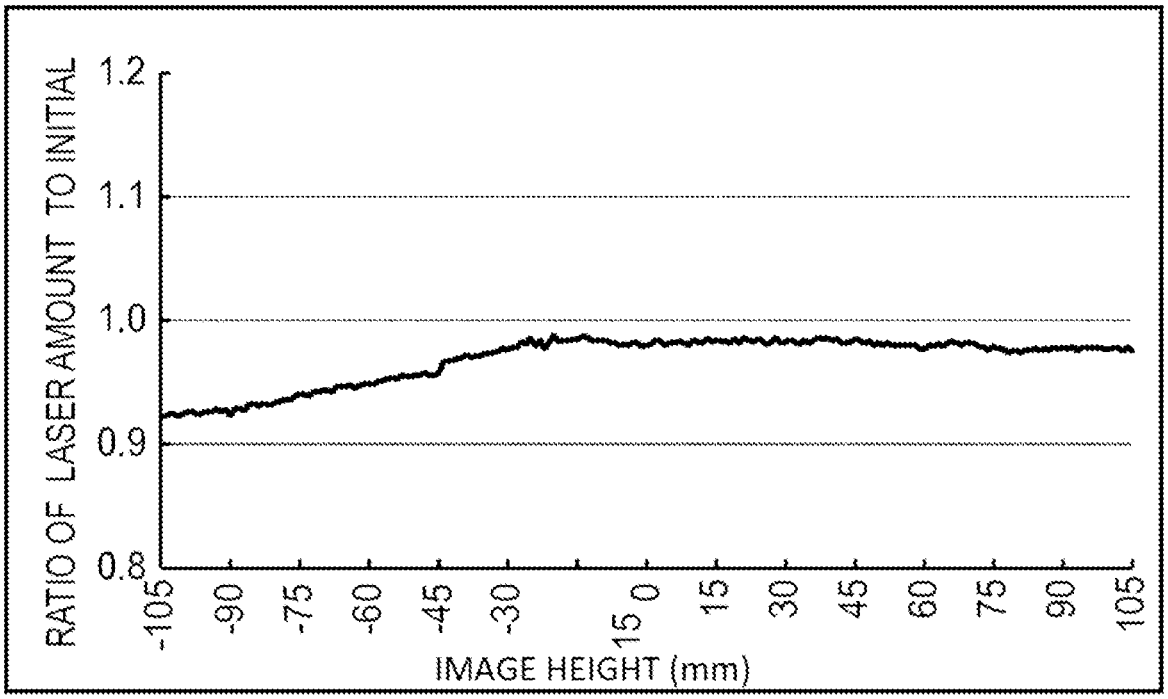

FIG. 5 shows a position (also referred to as an image height) (mm) in the main scanning direction on the photosensitive drum 1 on a horizontal axis, and a ratio of a laser light intensity at a given time which is a second timing, to a laser light intensity at an initial time which is a first timing, on a vertical axis. Incidentally, with regards to an image height of the photosensitive drum 1, a positive side corresponds to right side of the recording material 10, and a negative side corresponds to left side of the recording material 10. If a laser light intensity on the photosensitive drum 1 does not decrease compared to the initial time, a value of the vertical axis indicates "1.0", and a value of the vertical axis becomes smaller as a laser light intensity decreases. Part (a) of FIG. 5 shows a laser light intensity ratio on the photosensitive drum 1Y as a first photosensitive body of the first scanning optical system, and part (b) of FIG. 5 shows a laser light intensity ratio on the photosensitive drum 1K as a second photosensitive body of the second scanning optical system.

Each graph shows a laser light intensity ratio decreases at an image height on a side corresponding to a dirty part of the reflecting surface 33*a*. That is, in part (a) of FIG. 5, a laser light intensity on a surface of the photosensitive drum 1Y at a positive side of an image height corresponding to the contaminated part of the reflecting surface 33*a* (corresponding to a right side of the recording material 10) decreases compared to that at the initial time. In part (b) of FIG. 5, a laser light intensity on a surface of the photosensitive drum 1K at a negative side of an image height corresponding to a contaminated part of the reflecting surface 33*a* (corresponding to a left side of the recording material 10) decreases compared to that at the initial time. Both of the decreases of the laser light densities are larger at a starting side for writing of the laser light L of an image height. Incidentally, the left side of the recording material 10 is one side in the direction substantially perpendicular to the feeding direction, and the right side is the other side in the direction substantially perpendicular to the feeding direction.

In a case that scanning optical systems are provided on the left side and right side of the rotatable polygon mirror 33, as in the scanning optical device 3 in this embodiment, the following features are seen. That is, the most significant feature of the decrease in the laser light intensity on the photosensitive drum 1 when the reflecting surface 33*a* is contaminated as shown in FIG. 4 is that an image height at which a light intensity decreases greatly is reversed in the scanning optical systems on left side and right side as shown in FIG. 5. This is because the scanning optical systems on left side and right side share a rotatable polygon mirror 33 with a contaminated reflecting surface 33*a*. Further, magenta which uses the same first scanning optical system as yellow, and cyan which uses the same second scanning optical system as black are also greatly decreased in the laser light intensities at the same image height side as each scanning optical system compared to the initial time. Specifically, in a case of magenta, as in a case of yellow, the decrease in the laser light intensity compared to the initial time is larger at a positive side of the image height. In a case of cyan, as in a case of black, the decrease in the laser light intensity compared the initial time is larger at a minus side of the image height.

(Density Detection by a Density Sensor and a Detection Result)

Subsequently, a detection of a degradation state in the scanning optical device 3 of the opposite scanning optical system will be described with reference to FIGS. 6 through 9. The detection of the degradation state is performed by comparing image density results obtained by at least two density detection units, which are mounted to correct an image density without using a dedicated optical detection element in case of the image forming apparatus 100.

Figure 6:
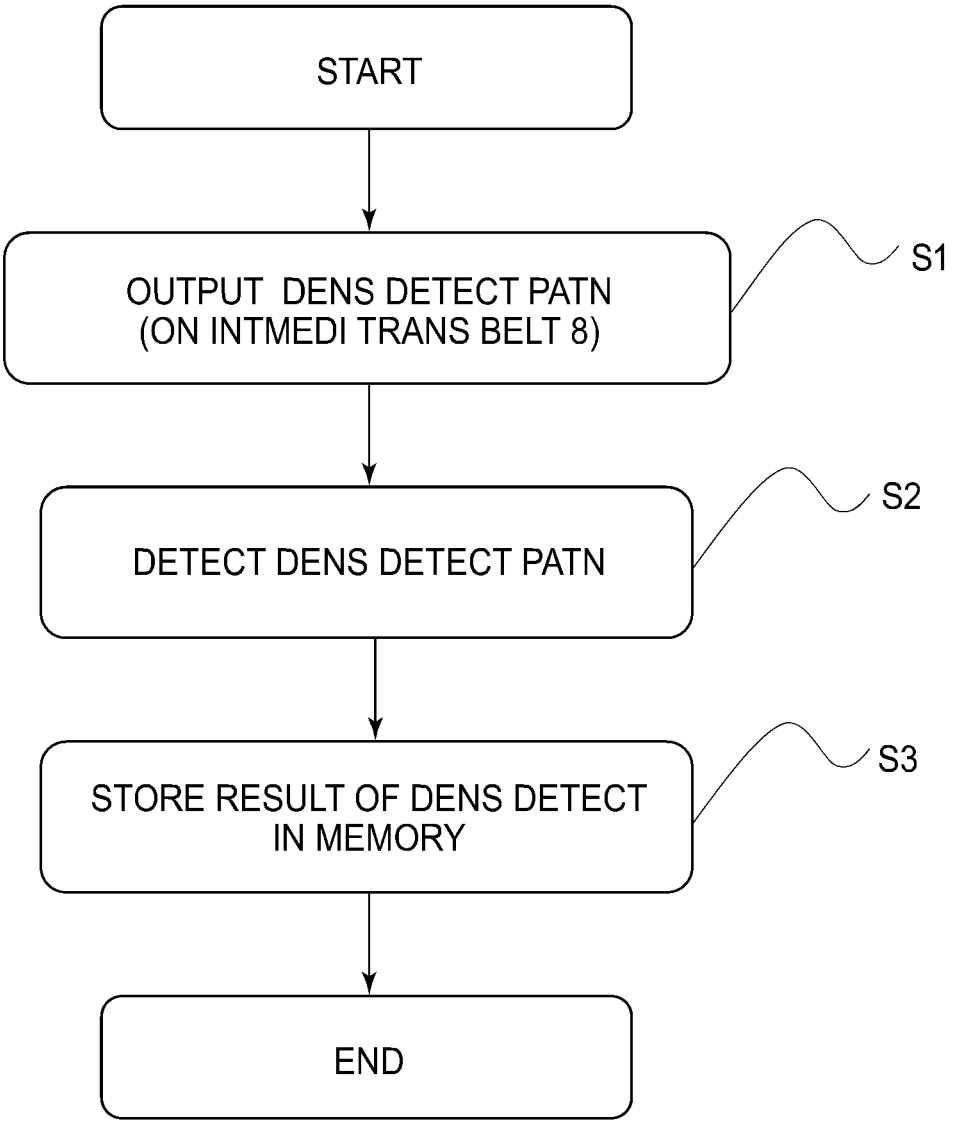
FIG. 6 is a flowchart showing a process from executing a density detection to storing a detecting result in the embodiment.
Figure 7:
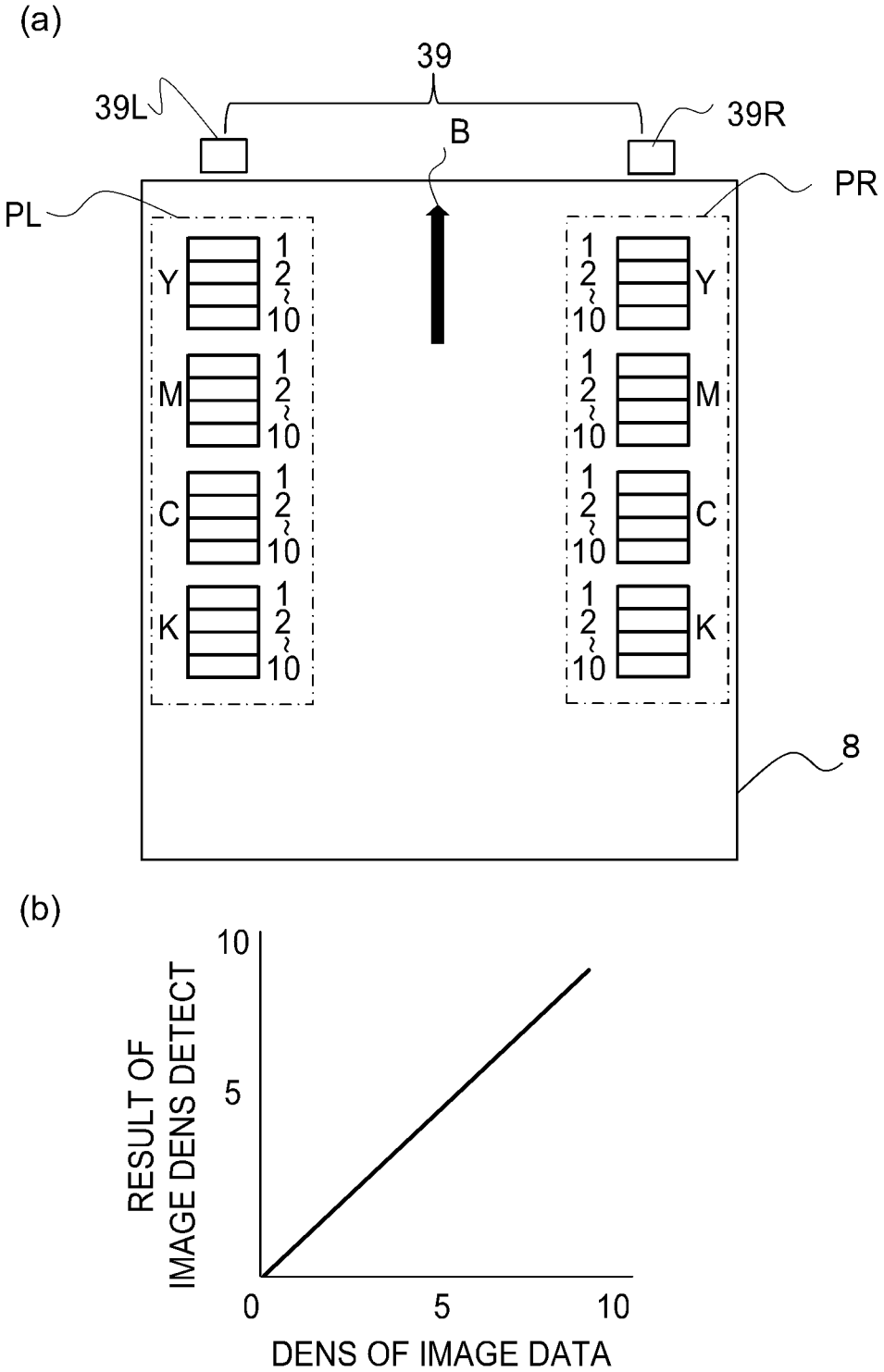
FIG. 7 is an illustration showing a density detection on an intermediary transfer belt and a graph showing a detecting result of density in the embodiment.

First of all, an image density detection will be described with reference to Figures FIG. 6 and FIG. 7. FIG. 6 is a flowchart showing a process from execution of density detection to storing a detection result, part (a) of FIG. 7 is an illustration showing a density detection, and part (b) of FIG. 7 is an illustration showing an example of a density detecting result. In FIG. 6, if a density detection is executed, the control portion 200 executes a process from step (hereinafter referred to as S) 1 onward. In S1, the control portion 200 rotates the intermediary transfer belt 8 in a direction of arrow B as shown in part (a) of FIG. 7 by a driving motor of the intermediary transfer belt 8 (not shown). As a result, pattern PL and PR for detecting a density of each color (hereinafter referred to as density detection patterns) are formed on the intermediary transfer belt 8 (on the image bearing belt) which is moving, by an operation up to a primary transfer described in FIG. 1. Incidentally, information on density detection patterns is stored in advance, for example, in a ROM provided with the control portion 200, and the control portion 200 forms density detection patterns on the intermediary transfer belt 8 based on information read from the ROM. Incidentally, Y in the density detection pattern PL corresponds to a first toner image, and Y in the density detection pattern PR corresponds to a second toner image. K in the density detection pattern PL corresponds to a third toner image, and K in the density detection pattern PR corresponds to a fourth toner image.

As shown in part (a) of FIG. 7, the density detection patterns PL and PR of each color are formed along the moving direction at both ends of the intermediary transfer belt 8 (two ends which are substantially parallel to the moving direction (arrow B direction)). In addition, the density detection patterns are formed in the following order from a front of the moving direction: yellow density detection patterns 1 to 10, magenta density detection patterns 1 to 10, cyan density detection patterns 1 to 10, and black density detection patterns 1 to 10. The density detection patterns on a left side of part (a) of FIG. 7 are collectively referred to as density detection patterns PL, and the density detection patterns on a right side are collectively referred to as density detection patterns PR. The density detection patterns PL and PR are output in such a way that density gradually becomes darker from 1 to 10, for example, a density of a density detection pattern 1 of each color is the lightest and a density of a density detection pattern 10 of each color is a solid density.

Here, a density sensor 39L, as a first detection unit, is arranged to oppose the density detection pattern PL on the intermediary transfer belt 8, and a density sensor 39R, as a second detection unit, is arranged to oppose the density detection pattern PR on the intermediary transfer belt 8. The density sensors 39L and 39R are collectively referred to as a density sensor 39. Here, both ends of the intermediary transfer belt 8 correspond to both ends in a direction perpendicular to the feeding direction of the recording material 10. That is, the density sensors 39L and 39R are arranged at positions corresponding to a vicinity of a left end and a vicinity of a right end in a printing region of the recording material 10, respectively. The density sensors 39L and 39R include, for example, a light emitting element and a light receiving element. Light emitted from the light emitting element is reflected by the density detection patterns PL, PR or the intermediary transfer belt 8, and the reflected light is received by the light receiving element. The density sensors 39L and 39R output a voltage (hereinafter referred to as a detection result) corresponding to a received light intensity to the control portion 200. Incidentally, a configuration of the density sensors 39L and 39R may be other configurations. Further, a configuration of the density detection pattern may also be other configurations.

Back to the description of FIG. 6 in S2, the control portion 200 detects the density detection patterns PL and PR using the density sensors 39L and 39R. Here, the density detection pattern PL indicates the density of each color detected by the density sensor 39L when it passes through the density sensor 39L. The density detection pattern PR indicates the density of each color detected by the density sensor 39R when it passes through the density sensor 39R. In S3, the control portion 200 stores detection results of a density of each color in ten steps on the intermediary transfer belt 8 obtained in S2 (hereinafter also referred to as an image density) and a corresponding image data density of each color in a storage portion such as RAM, and ends the process. In addition, data to be stored may be a slope value of a graph, which is approximated to a linear equation when image data densities on a horizontal axis and detection results of image densities obtained by the density sensor 39 on a vertical axis are plotted as shown in part (b) of FIG. 7. If a slope value is applied, the amount of data to be stored in the storage portion is reduced and a storage area of the storage portion is not occupied.

In order to detect a degradation state due to contamination of the rotatable polygon mirror 33 in the scanning optical device 3, it is necessary to store the detection results of the image density in the state where the rotating polyhedron 33 is not contaminated as initial data in the memory section in advance. The initial data should be stored in the memory section with the detection results in a state where the scanning optical device 3 is rarely operated, for example, at the time of shipment from the factory, at the time of installation of the image forming apparatus 100 in the user's place of use, and at the time of replacement of the scanning optical device 3.

(Detection of a Degradation State and an End of Lifetime of the Scanning Optical Device)

Figure 8:
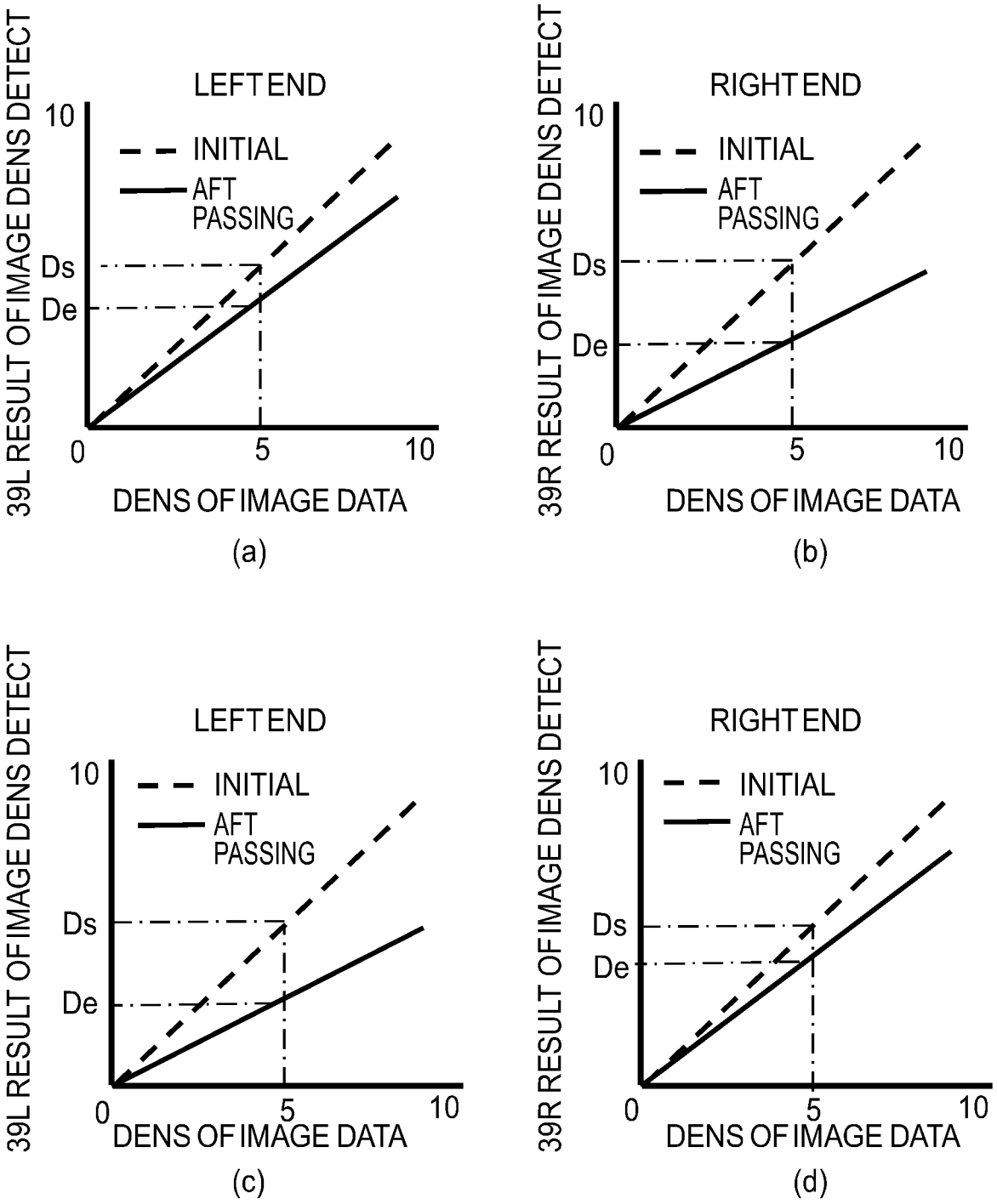
FIG. 8 depicts graphs showing an initial density and a detecting result of density after sheet passing in the embodiment.
Figure 9:
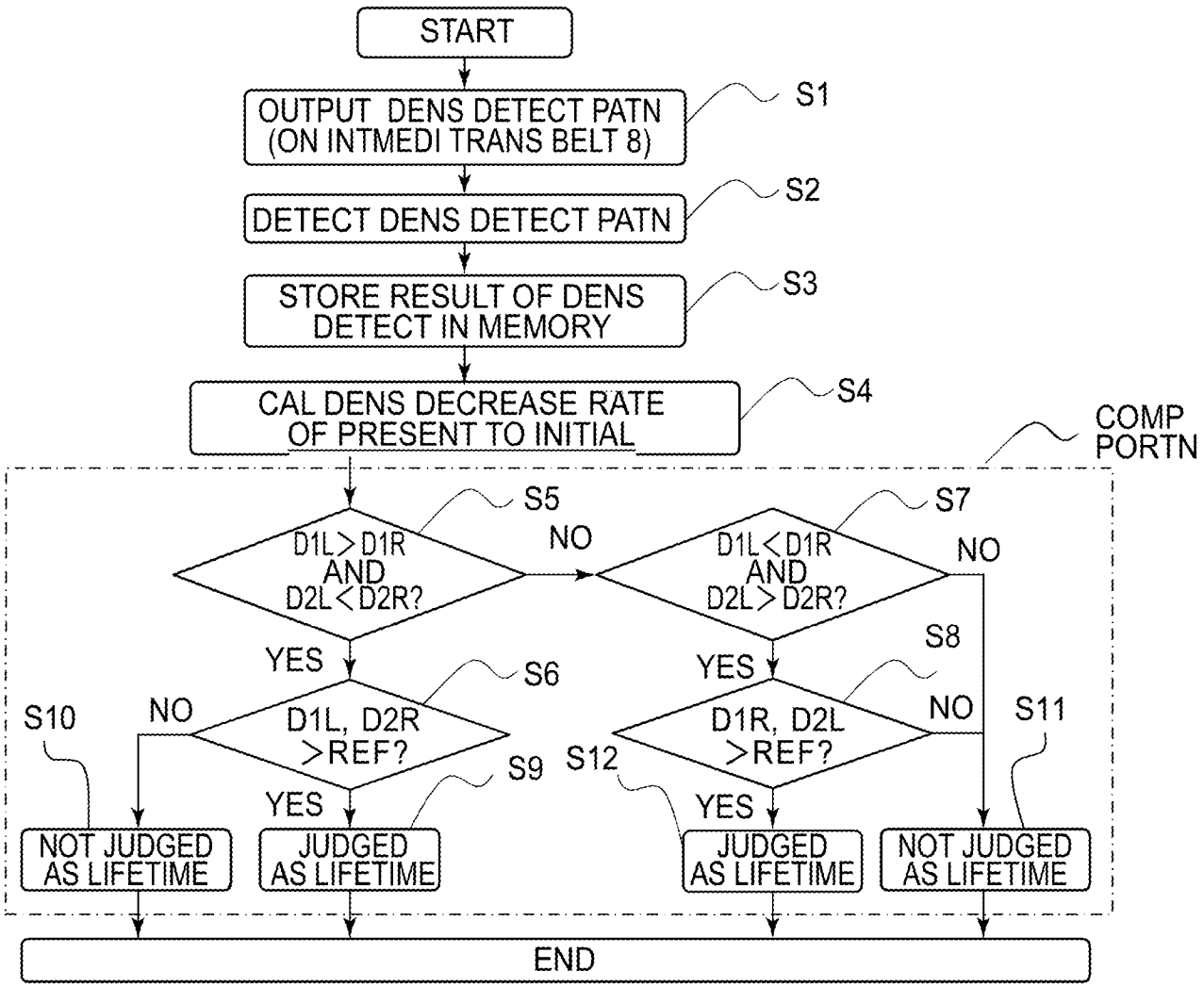
FIG. 9 is a flowchart showing a process from executing a density detection to determining an end of lifetime in the embodiment.

Subsequently, a comparison of detection results (hereinafter referred to as density data) obtained by two density sensors 39L and 39R and a determination of an end of lifetime of the scanning optical device 3 will be described with reference to FIG. 8 and FIG. 9. FIG. 8 is a graph describing a difference between initial density data and density data when a use of the scanning optical system 3 has been prolonged and the reflective surface 33*a* of the rotatable polygon mirror 33 is contaminated. FIG. 9 is a flowchart showing a process of determining an end of lifetime of the scanning optical device 3. Part (a) of FIG. 8 is a graph showing a detection result of density by the density sensor 39L in a case of a yellow pattern in the density detection pattern PL (left end), and a horizontal axis shows an image data density and a vertical axis shows a detection result. Part (b) of FIG. 8 is a graph showing a detection result of density by the density sensor 39R in a case of a yellow pattern in the density detection pattern PR (right end), and a horizontal axis shows an image data density and a vertical axis shows a detection result. Part (c) of FIG. 8 is a graph showing a detection result of density by the density sensor 39L in a case of a black pattern in the density detection pattern PL (left end), and a horizontal axis shows an image data density and a vertical axis shows a detection result. Part (d) of FIG. 8 is a graph showing a detection result of density by the density sensor 39R in a case of a black pattern in the density detection pattern PR (right end), and a horizontal axis shows an image data density and a vertical axis shows a detection result. In all of them, dashed lines show initial data and solid lines shows data (hereinafter referred to as data after sheet passing) when a use of the scanning optical system 3 has been prolonged and the reflecting surface 33*a* of the rotatable polygon mirror 33 is contaminated (hereinafter referred to as after sheet passing).

In FIG. 8, as a use of the scanning optical system 3 has been prolonged, the reflecting surface 33*a* of the rotatable polygon mirror 33 becomes contaminated. As a result, an actual image density (vertical axis) becomes thinner in comparison to image density data (horizontal axis) and is detected as a smaller value. Therefore, data after sheet passing (solid line) is plotted below initial data (dashed line). In other words, a slope of data after sheet passing becomes smaller than that of the initial data. Here, a rate of decrease in density after sheet passing (hereinafter referred to as a rate of decrease in density) in comparison to initial data will be defined. In part (a) of FIG. 8, for example, when an image data density (horizontal axis) is 5, an initial detection result is defined as Ds and a detection result after sheet passing is defined as De. In this case, a rate of decrease in density is expressed as $((Ds-De)/Ds)\times 100$ (unit: %). The larger a value of a rate of decrease in density, the lower a density compared to an initial value, that is, the scanning optical system 3 is in a degradation state. For example, if Ds=5, an initial value is De=Ds, and a rate of decrease in density is 0%, and for example, if Ds=2 after sheet passing, a rate of decrease in density is 60%.

In addition, comparing part (a) of FIG. 8 and part (b) of FIG. 8, the graphs suggest that a rate of decrease in density is larger in (b) than in (a). In other words, a decreased value in De against Ds is larger in (b) than in (a). This is because, as described in part (a) of FIG. 5, in a case of yellow, a light intensity decreases more on the right side of the recording material 10 than on the left side, since the reflecting surface 33*a* of the rotatable polygon mirror 33 is easily contaminated in the rotational direction. For the same reason, in a case of black, a rate of decrease in density is larger on the left end side of the recording material 10 (part (c) of FIG. 8), which is different (opposite) from a case of yellow. This relationship, in other words, the fact that an image height, whose rate of decrease in density is larger, is reversed (left and right are reversed) between the first scanning optical system (yellow) and the second scanning optical system (black), is a major feature of the opposite scanning optical system.

(Process for detecting a degradation state of a scanning optical device)

Subsequently, a determination process of an end of lifetime of the scanning optical device 3 will be described with reference to the flowchart in FIG. 9. The process of determining an end of lifetime of the scanning optical device 3 shown in FIG. 9 is executed at the second timing, after the first timing when an image has not been formed on the recording material 10, in order to form density detection patterns PL and PR on the intermediary transfer belt 8. Prior to the description, rates of decrease in density for each color and each density sensor 39 described above are defined as follows.

D1L: A rate of decrease in density at the left end side (the density sensor 39L) of the first scanning optical system (Y, M)

D1R: A rate of decrease in density at the right end side (the density sensor 39R) of the first scanning optical system (Y, M)

D2L: A rate of decrease in density at the left end side (density sensor 39L) of the second scanning optical system (K, C).

D2R: A rate of decrease in density at the right end side (density sensor 39R) of the second scanning optical system (K, C).

In FIG. 9, S1 to S3 are the same process as S1 to S3 in FIG. 6, so the description will be omitted, and comparisons of each rate of decrease in density in S4 and a comparison portion enclosed by a single dotted line will be described. In addition, it is assumed that the control portion 200 detects the density detection patterns PL and PR by the density sensors 39L and 39R at the initial time described above, and stores the detection results in the storage portion. In S4, the control portion 200 compares a detection result of an initial density stored in the storage portion in advance and a detection result of a current detection result of a density detected in S1 to S3. The control unit 200 calculates current rates of decrease in density against the initial time: D1L (the first value), D1R (the second value), D2L (the third value), and D2R (the fourth value).

In S5, the control portion 200 determines whether a rate of decrease in density D1L at the left end of the first scanning optical system is larger than a rate of decrease in density D1R at the right end of the first scanning optical system, and a rate of decrease in density D2L at the left end of the second scanning optical system is less than a rate of decrease in density D2R at the right end of the second scanning optical system. If the control unit 200 determines in S5 that D1L>D1R and D2L<D2R are true, a process goes to S6. If the control unit 200 determines that D1L>D1R and D2L<D2R are not true, a process goes to S7. In S6, the control portion 200 determines whether either of rates of decrease in density D1L or D2R which is larger in S5, is larger than a rate of decrease in density REF which is a predetermined threshold to determine an end of lifetime. In S6, if the control portion 200 determines that either one of D1L or D2R is larger than REF, a process goes to S9. If the control portion 200 determines that both D1L and D2R are smaller than or equal to REF, a process goes to S10. In S9, the control portion 200 determines that the scanning optical device 3 has reached an end of lifetime and ends a process. In S10, the control portion 200 does not determine that it is an end of lifetime of the scanning optical device 3, but continues to operate the scanning optical device 3, and ends a process.

In S7, the control portion 200 determines whether a rate of decrease in density D1L at the left end of the first scanning optical system is smaller than a rate of decrease in density D1R at the right end of the first scanning optical system and a rate of decrease in density D2L at the left end of the second scanning optical system is larger than a rate of decrease in density D2R at the right end of the second scanning optical system. In S7, if the control portion 200 determines that D1L<D1R and D2L>D2R are true, a process goes to S8. If the control portion 200 determines that D1L<D1R and D2L>D2R are not true, the process proceeds to S11. In S11, the control portion 200 does not determine that the scanning optical system 3 has reached an end of life, since it is not consistent with decrease in density due to contamination of the reflecting surface 33*a* of the rotatable polygon mirror 33, but continues to operate the scanning optical system 3, and ends the process.

In S8, the control portion 200 determines whether one of rates of decrease in density D1R or D2L which is larger in S7, is larger than a rate of decrease in density REF which is to determine an end of lifetime. In S8, if it determines that either one of D1R or D2L is larger than REF, a process goes to S12. If it determines that both D1R and D2L are smaller than or equal to REF, a process goes to S11. In S12, the control portion 200 determines that the decrease in density is due to contamination of the reflecting surface 33*a* of the rotatable polygon mirror 33, and determines that the scanning optical device 3 has reached an end of lifetime and ends a process. The control unit 200 also functions as a determining unit to determine an end of lifetime of the scanning optical device 3. Incidentally, in this embodiment, a value of a rate of decrease in density REF is set to for example 30%. The value of the rate of decrease in density REF may be set, for example, to the value such that a quality of an image formed on the recording material 10 is impaired if a rate of decrease in density decreases beyond the value with respect to a contamination of the reflecting surface 33*a* of the rotatable polygon mirror 33. Incidentally, in this embodiment, a rate of decrease in density REF of S6 and a rate of decrease in density REF of S8 are set to the same value, however, they may be set to different values. In addition, the control portion 200 may determine that it has reached an end of lifetime if it determines that both of rates of decrease in density are larger than REF in determining processes of S6 and S8. The control portion 200 in this embodiment determines an end of lifetime of the scanning optical device 3 by the processes described above. If it determines that the scanning optical device 3 has reached an end of lifetime, information to promote a user to exchange the scanning optical device 3 may be displayed, for example, on an operational panel (not shown) which is a notifying unit in the image forming apparatus 100. As described above, it is possible to simply and accurately detect a degradation state due to contamination of the rotatable polygon mirror of the scanning optical device used in the image forming apparatus, by comparing the results of at least two image density detecting units, without using a dedicated optical detection element.

OTHER EMBODIMENTS

Figure 10:
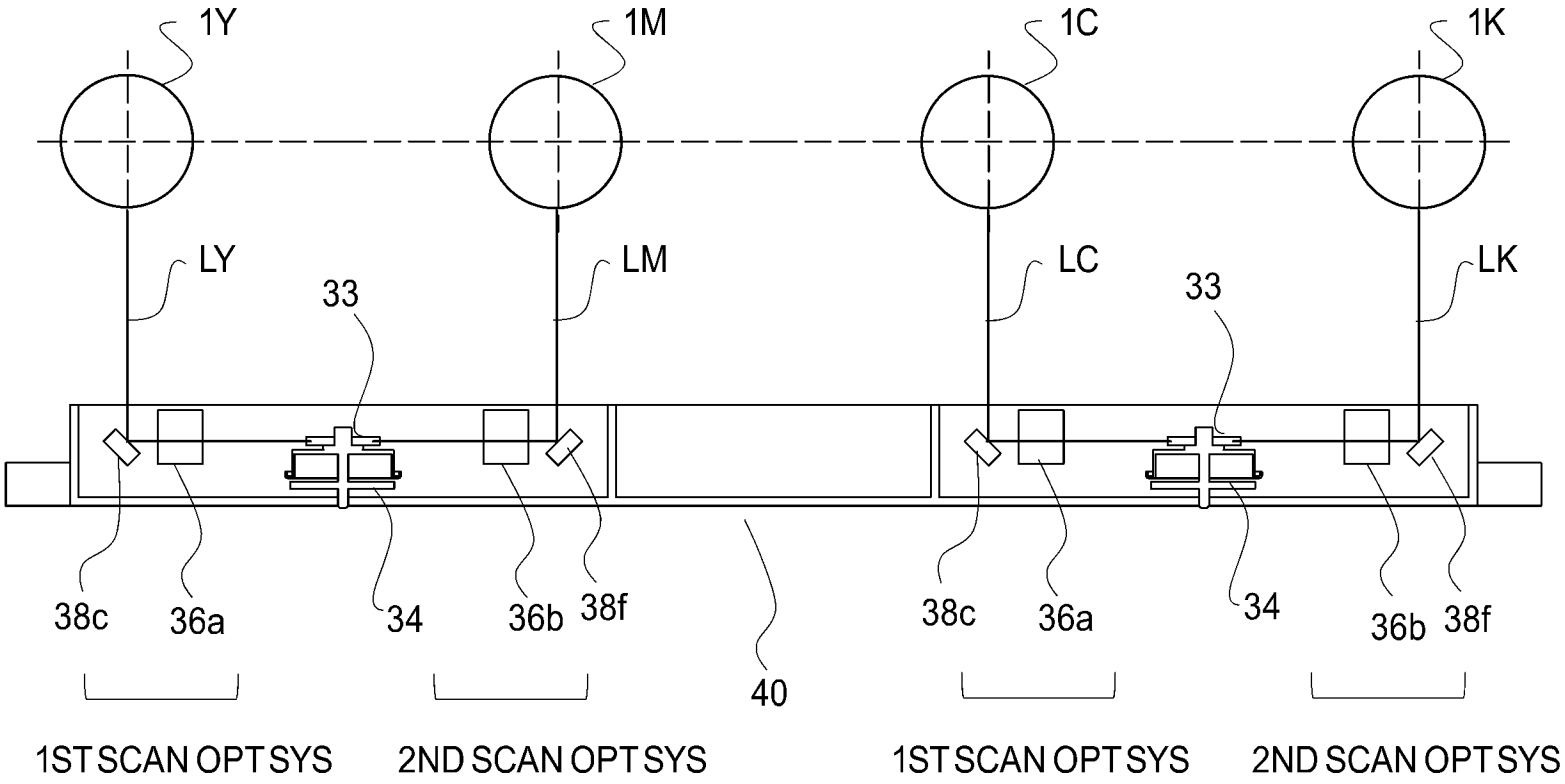
FIG. 10 is a cross sectional view of a scanning optical device in another embodiment.

In this the prior embodiment, a single rotatable polygon mirror 33 scans the laser light L for four colors. However, for example, as shown in FIG. 10, the scanning optical device 40, which includes two sets of one rotatable polygon mirror 33 scanning laser light for two colors, makes it possible to determine an end of lifetime in the same way. In FIG. 10, parts which have the same functions as the scanning optical device 3 in FIG. 2 and FIG. 3 are marked with the same sign. In this case, yellow and cyan are in the first scanning optical system, and magenta and black are in the second scanning optical system. Incidentally, in this embodiment, a detection result at specific image data "5" is used to calculate a rate of decrease in density, but this is not limited to this. It is also possible to determine an end of lifetime by calculating a rate of decrease in density from a slope of the graph plotted in FIG. 8. In a case of calculating from the slope, if an initial slope is Ds' and a slope after sheet passing is De', a rate of decrease in density is $((Ds'-De')/Ds')\times 100$ (unit: %). As explained above, according to this embodiment, it is possible to detect a degradation state due to contamination of the rotatable polygon mirror of the scanning optical device used in the color image forming apparatus without using a dedicated optical element. In this embodiment, it is possible to determine an end of lifetime of the scanning optical device accurately in a simple way, by comparing results of at least two density sensors which detect image density arranged within an image printing region. In summary, according to this embodiment, it is possible to accurately detect the contamination of the rotatable polygon mirror of the scanning optical device in a simple way without using a dedicated optical detection element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-153953 filed on Sep. 14, 2020, which is hereby incorporated by reference herein in its entirety.

What is claimed is:

1. An image forming apparatus for forming a toner image on a recording material, said image forming apparatus comprising:

a photosensitive member;

an exposure unit, provided with a light source and a rotatable polygon mirror including a plurality of reflecting surfaces for scanning a light beam emitted from said light source, and configured to expose said photosensitive member with the light beam according to image information;

a developing roller configured to supply toner to said photosensitive member and develop an electrostatic latent image formed on said photosensitive member by said exposure unit and to form the toner image;

an image bearing belt;

a transfer roller configured to transfer the toner image formed on said photosensitive member to said image bearing belt;

at least two density sensors configured to sense density of the toner image formed on said image bearing belt; and a controller configured to determine an end of lifetime of said exposure unit based on a detecting result of density of the toner image detected by said two density sensors at a first timing, and a detecting result of density of the toner image detected by said two density sensors at a second timing after the first timing.

2. The image forming apparatus according to claim 1, wherein said two density sensors include a first density sensor provided at a position corresponding to one end portion of the recording material with respect to a direction substantially perpendicular to a feeding direction of the recording material and opposite to said image bearing belt, and a second density sensor provided at a position corresponding to the other end portion of the recording material with respect to the direction substantially perpendicular to the feeding direction of the recording material and opposite to said image bearing belt.

3. The image forming apparatus according to claim 2, further comprising:

at least two said light sources; and at least two said photosensitive members, wherein said exposure unit includes a first lens configured to guide the light beam scanned by said rotatable polygon mirror with respect to a first scanning direction and emitted from a first light source of at least two said light sources to a first photosensitive member of at least two said photosensitive members, and a second lens configured to guide the light beam scanned by said rotatable polygon mirror with respect to a second scanning direction opposite to the first scanning direction and emitted from a second light source of at least two said light sources to a second photosensitive member of at least two said photosensitive members.

4. The image forming apparatus according to claim 3, wherein said controller determines the end of lifetime of said exposure unit based on:

a first value based on a detecting result, of a first toner image on said image bearing belt corresponding to the toner image formed on said first photosensitive member, detected by said first density sensor at the first timing and a detecting result detected by said first density sensor at the second timing, a second value based on a detecting result, of a second toner image on said image bearing belt corresponding to the toner image formed on said first photosensitive member, detected by said second density sensor at the first timing and a detecting result detected by said second density sensor at the second timing, a third value based on a detecting result, of a third toner image on said image bearing belt corresponding to the toner image formed on said second photosensitive member, detected by said first density sensor at the first timing and a detecting result detected by said first density sensor at the second timing, and a fourth value based on a detecting result, of a fourth toner image on said image bearing belt corresponding to the toner image formed on said second photosensitive member, detected by said second density sensor at the first timing and a detecting result detected by said second density sensor at the second timing.

5. The image forming apparatus according to claim 4, wherein said controller determines a contamination of said reflecting surfaces of said rotatable polygon mirror as indicating the end of lifetime of said exposure unit when the second value is greater than the first value, the third value is greater than the fourth value, and the second value and the third value are greater than a predetermined value.

6. The image forming apparatus according to claim 1, further comprising a display configured to display information promoting exchange of said exposure unit to a user in a case in which said controller determines the end of lifetime of said exposure unit.

7. An image forming apparatus for forming a toner image on a recording material, said image forming apparatus comprising:

a first photosensitive member;

a second photosensitive member;

a laser scanner configured to scan said first photosensitive member with first laser light and said second photosensitive member with second laser light, said laser scanner including a first light source emitting the first laser light according to first image information, a second light source emitting the second laser light according to second image information, and a rotatable polygon mirror that deflects the first laser light emitted from said first light source toward said first photosensitive member and deflects the second laser light emitted from said second light source toward said second photosensitive member;

a first developing roller configured to supply toner to said first photosensitive member to develop a first electrostatic latent image formed with the first laser light into a first toner image;

a second developing roller configured to supply toner to said second photosensitive member to develop a second electrostatic latent image formed with the second laser light into a second toner image;

an intermediary transfer belt to which the first toner image and the second toner image are transferred and which carries the first toner image and the second toner image;

a first density sensor configured to sense density of the first toner image and density of the second toner image on said intermediary transfer belt;

a second density sensor configured to sense density of the first toner image and density of the second toner image on said intermediary transfer belt; and a controller configured to control said image forming apparatus, wherein as viewed in a rotational axis direction of said rotatable polygon mirror, a direction in which the second laser light is reflected by said rotatable polygon mirror is opposite to a direction in which the first laser light is reflected by said rotatable polygon mirror, wherein with respect to a direction perpendicular to a rotational direction of said intermediary transfer belt, said first density sensor senses the first toner image and the second toner image transferred near one end of said intermediary transfer belt, and said second density sensor senses the first toner image and the second toner image transferred near the other end of said intermediary transfer belt, and wherein said controller determines an end of lifetime of said laser scanner based on a difference between a density of the first toner image sensed by said first density sensor and a density of the first toner image sensed by said second density sensor, and a difference between a density of the second toner image sensed by said first density sensor and a density of the second toner image sensed by said second density sensor.

8. An image forming apparatus for forming a toner image on a recording material, said image forming apparatus comprising:

a first photosensitive member;

a second photosensitive member;

a laser scanner configured to scan said first photosensitive member with first laser light and said second photosensitive member with second laser light, said laser scanner including a first light source emitting the first laser light according to first image information, a second light source emitting the second laser light according to second image information, and a rotatable polygon mirror that deflects the first laser light emitted from said first light source toward said first photosensitive member and deflects the second laser light emitted from said second light source toward said second photosensitive member;

a first developing roller configured to supply toner to said first photosensitive member to develop a first electrostatic latent image formed with the first laser light into a first toner image;

a second developing roller configured to supply toner to said second photosensitive member to develop a second electrostatic latent image formed with the second laser light into a second toner image;

an intermediary transfer belt to which the first toner image and the second toner image are transferred and which carries the first toner image and the second toner image;

a first density sensor configured to sense density of the first toner image and density of the second toner image on said intermediary transfer belt;

a second density sensor configured to sense density of the first toner image and density of the second toner image on said intermediary transfer belt; and a controller configured to control said image forming apparatus, wherein as viewed in a rotational axis direction of said rotatable polygon mirror, a direction in which the second laser light is reflected by said rotatable polygon mirror is opposite to a direction in which the first laser light is reflected by said rotatable polygon mirror, wherein with respect to a direction perpendicular to a rotational direction of said intermediary transfer belt, said first density sensor senses the first toner image and the second toner image transferred near one end of said intermediary transfer belt, and said second density sensor senses the first toner image and the second toner image transferred near the other end of said intermediary transfer belt, and wherein said controller determines an end of lifetime of said laser scanner based on a density (1) of the first toner image sensed by said first density sensor at a first timing, a density (2) of the first toner image sensed by said second density sensor at the first timing, a density (3) of the second toner image sensed by said first density sensor at the first timing, a density (4) of the second toner image sensed by said second density sensor at the first timing, a density (5) of the first toner image sensed by said first density sensor at a second timing after the first timing, a density (6) of the first toner image sensed by said second density sensor at the second timing, a density (7) of the second toner image sensed by said first density sensor at the second timing, and a density (8) of the second toner image sensed by said second density sensor at the second timing.

9. The image forming apparatus according to claim 8, wherein said controller determines the end of lifetime of said laser scanner in a case in which a rate of decrease in density D1L defined by a difference between the density (5) and the density (1) is greater than a rate of decrease in density D1R defined by a difference between the density (6) and the density (2), and a rate of decrease in density D2L defined by a difference between the density (7) and the density (3) is less than a rate of decrease in density D2R defined by a difference between the density (8) and the density (4).

* * * * *